United States Patent [19]

Thorn

[11] Patent Number: 4,901,493

[45] Date of Patent: Feb. 20, 1990

[54] DOOR ASSEMBLY

[75] Inventor: John F. Thorn, Sylvania, Ohio

[73] Assignee: Therma-Tru Corp., Toledo, Ohio

[21] Appl. No.: 284,494

[22] Filed: Dec. 15, 1988

[51] Int. Cl.[4] ..... E06B 3/00

[52] U.S. Cl. ..... 52/309.9; 52/455; 52/656; 52/781

[58] Field of Search ..... 52/208, 309.4, 309.7, 52/309.9, 309.11, 455–456, 656, 788, 789, 790, 780, 781, 488; 49/501, DIG. 2

[56] References Cited

U.S. PATENT DOCUMENTS

| | | | |
|---|---|---|---|
| 653,400 | 7/1900 | Rapp | 52/455 |
| 751,435 | 2/1904 | Ohnstrand . | |
| 1,183,842 | 5/1916 | Alling | 52/455 X |
| 1,249,814 | 12/1917 | Otte . | |
| 2,849,758 | 9/1958 | Plumley et al. . | |
| 2,871,056 | 1/1959 | Levitt . | |
| 2,890,977 | 6/1959 | Bayer et al. . | |
| 2,924,860 | 2/1960 | Parham, Jr. et al. . | |
| 3,153,817 | 10/1964 | Pease, Jr. . | |
| 3,225,505 | 12/1965 | Lytz . | |
| 3,250,041 | 5/1966 | Anger . | |
| 3,299,595 | 1/1967 | Munk . | |
| 3,402,520 | 9/1968 | Lee et al. . | |
| 3,404,502 | 10/1968 | Miller | 52/455 X |
| 3,498,001 | 3/1970 | MacDonald . | |
| 3,512,304 | 5/1970 | Meuret . | |
| 3,546,841 | 12/1970 | Smith et al. . | |
| 3,593,479 | 7/1971 | Hinds . | |
| 3,772,241 | 11/1973 | Kroekel . | |
| 3,883,612 | 5/1975 | Pratt et al. . | |
| 3,950,894 | 4/1976 | DiMaio . | |
| 3,961,012 | 6/1976 | DiMaio . | |
| 4,022,644 | 5/1977 | Smith, Jr. . | |
| 4,132,042 | 1/1979 | DiMaio . | |
| 4,152,876 | 5/1979 | Seely . | |
| 4,236,365 | 12/1980 | Wheeler | 52/455 |
| 4,265,067 | 5/1981 | Palmer . | |
| 4,311,183 | 1/1982 | Herbst et al. . | |
| 4,327,535 | 5/1982 | Governale | 52/309.11 |
| 4,374,693 | 2/1983 | Pitt . | |
| 4,429,493 | 2/1984 | St. Aubin . | |
| 4,496,201 | 1/1985 | Allgeyer . | |
| 4,546,585 | 10/1985 | Governale . | |
| 4,550,540 | 11/1985 | Thorn . | |
| 4,635,421 | 1/1987 | Newberg . | |
| 4,720,951 | 1/1988 | Thorn et al. . | |
| 4,811,538 | 3/1989 | Lehnert et al. | 52/455 |

FOREIGN PATENT DOCUMENTS

| | | |
|---|---|---|
| 898855 | 2/1984 | Belgium . |
| 2258510 | 8/1975 | France . |
| 2304763 | 11/1976 | France . |
| 551432 | 5/1977 | U.S.S.R. . |
| 604937 | 4/1978 | U.S.S.R. . |
| 1420244 | 1/1976 | United Kingdom . |
| 1487309 | 9/1977 | United Kingdom . |
| 2044316 | 10/1980 | United Kingdom . |
| 2057037 | 3/1981 | United Kingdom . |

*Primary Examiner*—Richard E. Chilcot, Jr.
*Attorney, Agent, or Firm*—Emch, Schaffer, Schaub & Porcello Co.

[57] ABSTRACT

An improved door assembly having compression molded frame skins defining a central opening, compression molded panel skins in said central opening and a unitary foam core for the panel and the frame is provided. The frame skins and panel skins define cavities which communicate with each other. The panel skins may occupy all or only a portion of the central opening and may be formed in a number of different configurations.

26 Claims, 4 Drawing Sheets

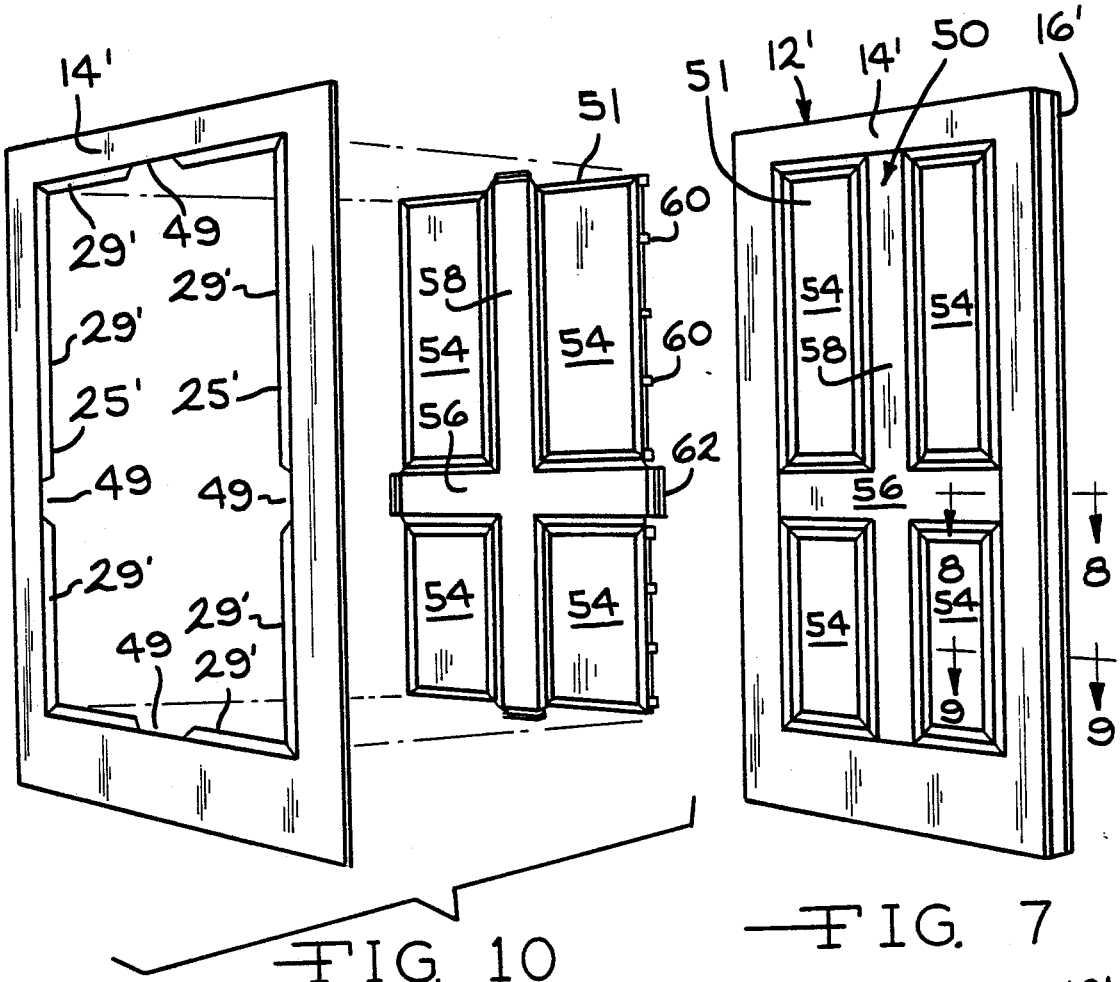
FIG. 10
FIG. 7
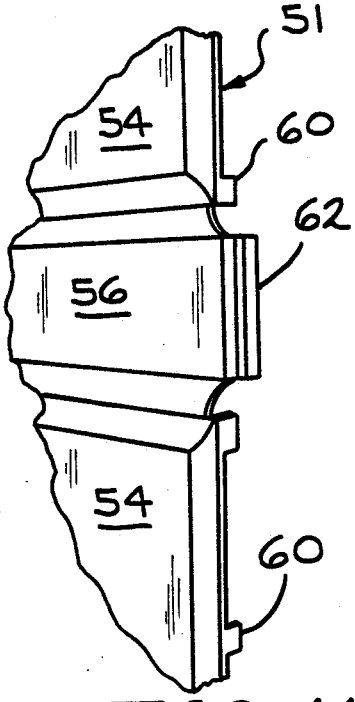
FIG. 11
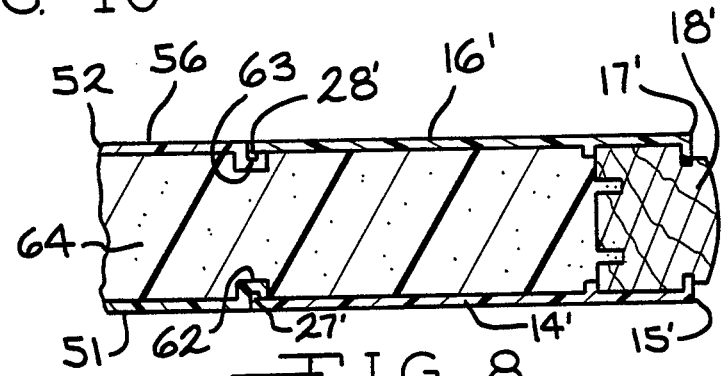
FIG. 8
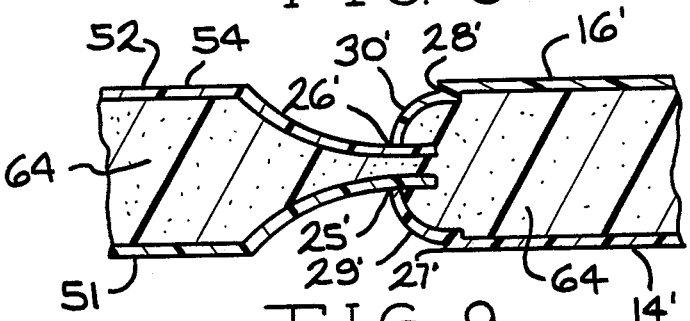
FIG. 9

FIG. 12
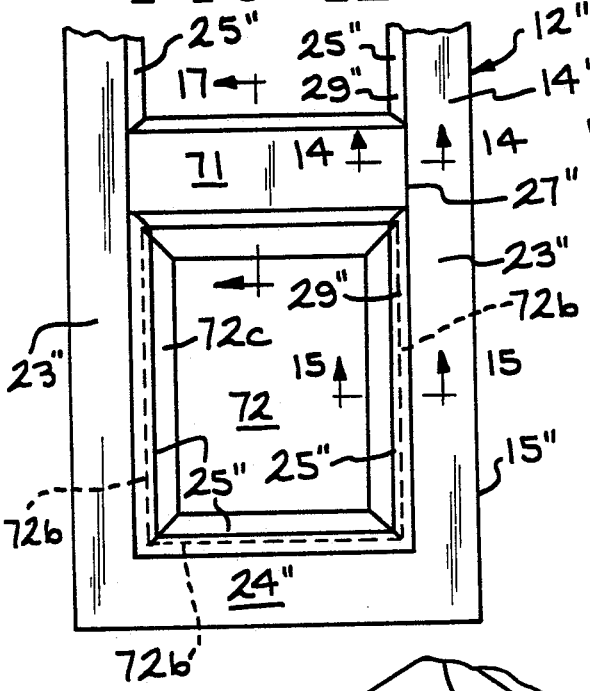
FIG. 13
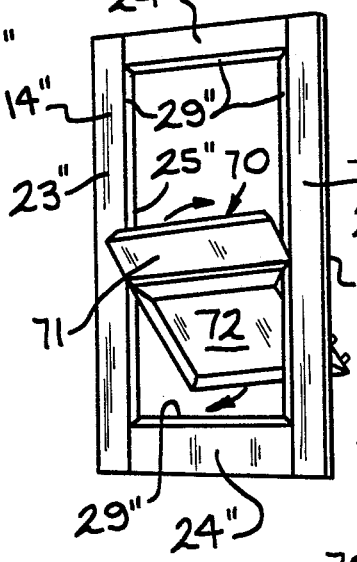
FIG 14
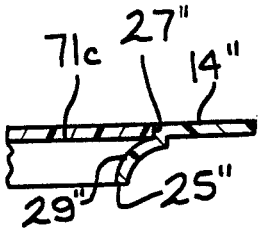
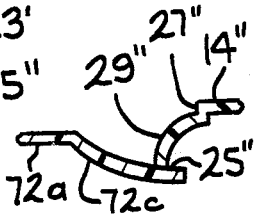
FIG. 15
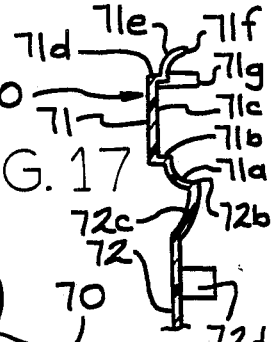
FIG. 17
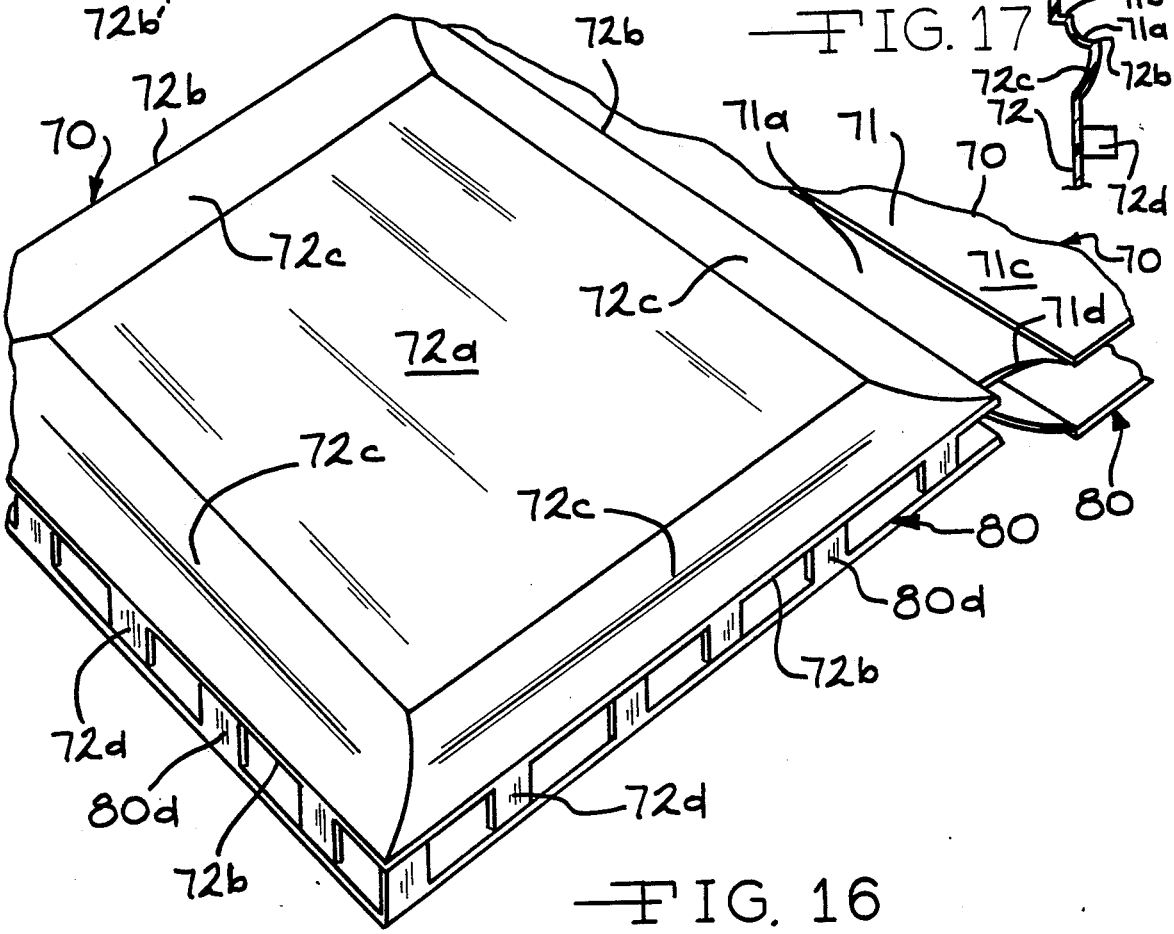
FIG. 16

DOOR ASSEMBLY

BACKGROUND OF THE INVENTION

The present invention relates to an improved door assembly having a frame comprising opposed inner and outer compression molded skins which define a cavity for receiving a foam core and a central panel positioned within such frame. The central panel has inner and outer compression molded skins defining a cavity which communicates with the frame cavity and also receives the foam core.

There has been an increased demand for fabricated door assemblies with improved weather and thermal characteristics and increased durability. Doors that are all wood tend to rot with time and prolonged exposure to the elements. Wood also exhibits a high degree of expansion and contraction which makes sizing and operation of the assembly difficult. Both wood and metal frames are poor insulators when compared to certain plastics, foams and glass reinforced resin products. The seal between the frame and the framed material is also important to an efficient high quality door assembly. Poor seals provide inferior vapor barriers between the interior and exterior of the door.

It is an object of the present invention to provide a door assembly which is relatively lightweight and thermally efficient.

A prior frame assembly for doors and windows is disclosed in U.S. Pat. No. 4,720,951 of which I am a co-inventor. Under the invention disclosed in that patent, the frame assembly includes a first skin and a second skin in opposed relationship with each other and having a cavity defined therebetween in which a foamable insulating material is placed. The foamable insulating material fills the cavity and surrounds the edge of the central panel to form a weather resistant seal between the frame and the edge of the central panel, which central panel will frequently be multiple panes of glass.

Under the present invention, the construction is such as to permit the foam insulating material forming the core to be flowed into the frame cavity and from such frame cavity directly into the central panel cavity during the assembly operation to form the completed door assembly having a unitary foam core.

Accordingly, it is a further object of this invention to provide a door assembly in which the foam material forming the insulating core may be effectively and efficiently flowed into the frame and central panel in one operation irrespective of whether the central panel has cross and center rails integral with or separate from recessed panels.

The present invention includes modular elements of various configurations of panels and frames which can be combined, with or without glass panels, to form a wide variety of door assemblies.

Accordingly, it is a further object of the present invention to provide a generic central panel which may have one of a variety of specific configurations and which may be assembled with a standard frame to form an improved door assembly.

It is yet another object of this invention to provide a door assembly having effective fastening means for securing the members forming the central panel to the members forming the frame.

Other objects and advantages of the present invention will become apparent from the following specification, drawings and claims.

SUMMARY OF THE INVENTION

The present invention relates to an improved door assembly having a frame formed of inner and outer compression molded skins and which, as assembled, has a rectangular configuration with a pair of vertical stiles and upper and lower horizontal rails. The stiles and rails cooperate to define an opening in which a central panel is positioned. The central panel, which is also formed of opposing compression molded skins, may occupy the entire opening or only a portion of the opening with the remainder being occupied by a glass window of single or multiple panes. The inner and outer skins of the frame define a cavity for receiving a foam core and the inner and outer skins of the central panel themselves define a cavity for receiving a foam core. The central panel may have cross and center rails integral with or separate from the skins forming the recessed panels. Means are provided for fastening the skins forming the central panel to the skins forming the frame. Means are also provided for communication between the cavity of the frame and the cavity of the central panel so that the frame skins and panel skins may be assembled as a unit and the foam core then flowed through an opening in the edge of the frame, through the frame cavity and into the central panel cavity to form a continuous foam core for the entire door assembly. The foamable core material possesses adhesive characteristics for bonding the respective skins together to form a completed door assembly.

BRIEF DESCRIPTION OF THE DRAWINGS

FIG. 7 is a perspective view of an assembled door of a modified embodiment.

FIG. 8 is a partial sectional view taken through line 8—8 of FIG. 7.

FIG. 9 is a partial sectional view taken through line 9—9 of FIG. 7.

FIG. 10 is a perspective view of one skin forming a portion of the frame and one skin forming a portion of the central panel of the embodiment of FIG. 7 showing such skins separated before assembly.

FIG. 11 is an enlarged fragmentary view of the edge of one of the central panel skins of the embodiment of FIG. 7.

FIG. 12 is a fragmentary elevational view of a modified door assembly including a modified central panel.

FIG. 13 is a schematic view showing the motions required to position one of the central panel skins in one of the frame skins preparatory to assembling the modified door assembly of FIG. 12.

FIG. 14 is a partial sectional view taken through line 14—14 of FIG. 12.

FIG. 15 is a partial sectional view taken through line 15—15 of FIG. 12.

FIG. 16 is a fragmentary perspective view of two skins forming the central panel of the embodiment of FIG. 12 showing the passages for introduction of foam from the frame.

FIG. 17 is a partial sectional view taken through line 17—17 of FIG. 12.

DESCRIPTION OF THE PREFERRED EMBODIMENTS

Figure 1:
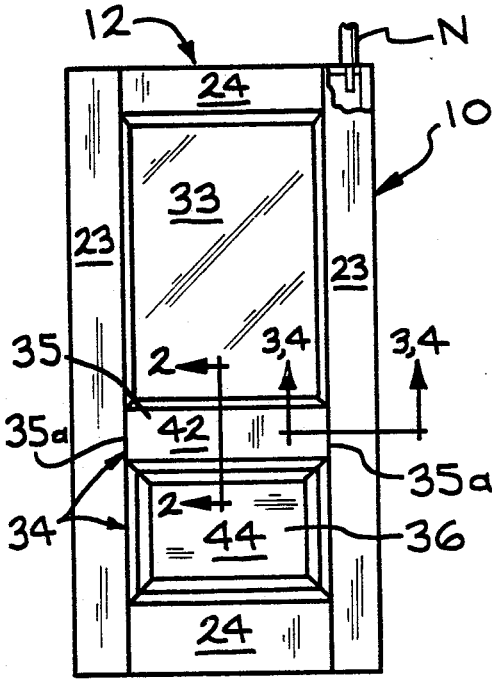
FIG. 1 is an elevational view of a door assembly according to the present invention.

Referring to FIGS. 1-6, there is provided a door assembly generally designated by the numeral 10 having a frame generally designated 12. The frame is produced from an inner compression molded skin 14 and an outer compression molded skin 16 joined together at their outer edges by wooden stiles 18 which may extend around the entire periphery and form the exterior edges of the frame. If desired, the bottom of the frame may be provided with a door bottom and sill assembly of the type disclosed in U.S. Pat. No. 4,411,104 in place of a wooden stile 18. The skins 14 and 16 are positioned in generally parallel spaced relationship and cooperate with the wooden stiles 18 to define a cavity 20 in which a foam core 22 may be introduced.

As can be seen from FIG. 1, the frame is in the shape of a rectangle with a pair of vertical stiles 23 and a pair of horizontal rails 24. Each of the skins 14 and 16 extends from its respective exterior edge 15 or 17 adjacent the wooden stiles 18 to an interior edge 25 or 26. The interior edges 25 and 26 define an opening in which a central panel and, if desired, a window may be positioned. As can be seen from FIGS. 3 and 4, the cross-sectional configuration taken through the vertical stiles 23 is such that the skins 14 and 16 extend from exterior edges 15 and 17, respectively, toward the respective interior edges 25 and 26 following a generally planar path to a step 27 in the case of skin 14 and a step 28 in the case of skin 16. Arcuate segments 29 and 30 of skins 14 and 16, respectively, join the steps 27 and 28 with the interior edges 25 and 26. The arcuate segments curve inwardly toward the opposing skins; however, the edges 25 and 26 are spaced apart when the skins 14 and 16 are joined to the stiles 18 to form the frame. A series of spaced apart abutments 31 and 32 extend from the interior surface of the skins 14 and 16 at the respective steps. The portion of the skins forming the horizontal rails 24 have a similar configuration.

In the embodiment of FIGS. 1-6, the frame 12 secures and retains three separate units in the opening, namely, a window panel 33 which may be formed of single or multiple panes of glass and a double unit central panel 34. The central panel 34 in the embodiment of FIGS. 1-6 includes a first inner compression molded skin 35, a second inner compression molded skin 36, a first outer compression molded skin 37 and a second outer compression molded skin 38. The first inner skin 35 cooperates with the first outer skin 37 to form a horizontal rail 42 while the second inner skin 36 cooperates with the second outer skin 38 to form a recessed panel 44. The window panel 33 in the upper portion of the opening includes a pair of spaced apart glass window panes 46. As will be obvious to those skilled in the art, if desired, the window panes 46 could be replaced with other compression molded skins forming a panel similar to recessed panel 44.

Figure 3:
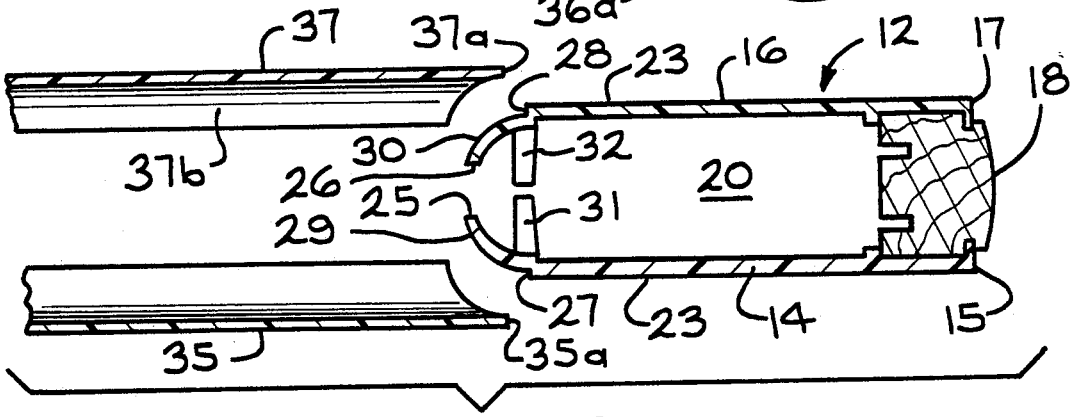
FIGS. 3 and 4 are partial sectional views taken through lines 3—3 and 4—4 of FIG. 1, with FIG. 3 showing the skin members forming the central rail separated before assembly and FIG. 4 showing them joined following assembly with the foam core in place.
Figure 4:
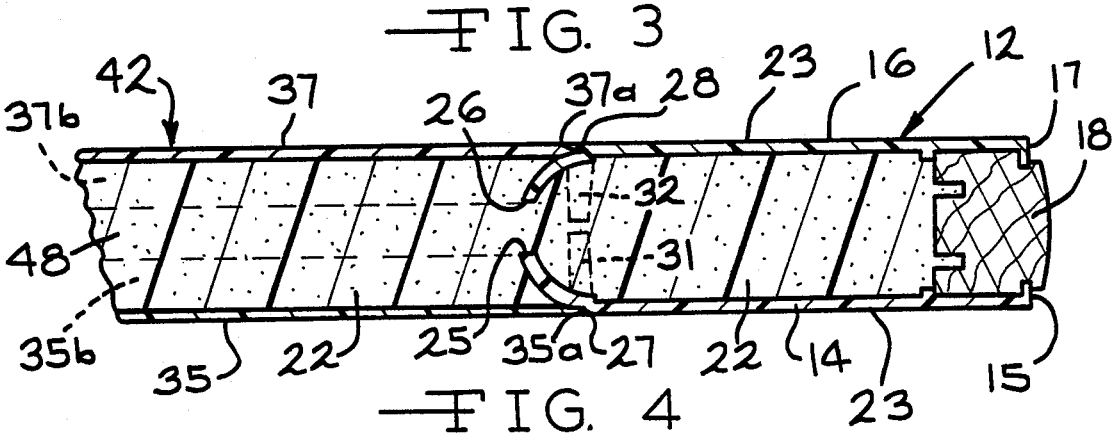

As can be seen from FIGS. 1, 3 and 4, the first inner skin 35 and the first outer skin 37 extend the full distance between the vertical stiles 23 and terminate at edges 35*a* and 37*a*, respectively, which abut against the step 27 of skin 14 in the case of end 35*a* and step 28 of skin 16 in the case of end 37*a*. As can be seen from FIG. 4, when the end 35*a* of skin 35 and the end 37*a* of skin 37 are positioned in such abutting relationship with the respective steps 27 and 28, the skins 35 and 37 cooperate with each other and with the frame 12 to define a cavity 48. The interior edges 25 and 26, respectively, of skins 14 and 16 forming the frame 12 are spaced apart from one another so that upon introduction of foamable core material into the frame cavity 20, such foam material may flow to the cavity 48 so that a unitary foam core is produced for the frame and the rail portion 42 of the central panel as defined by the first inner skin 35 and first outer skin 37.

Figure 2:
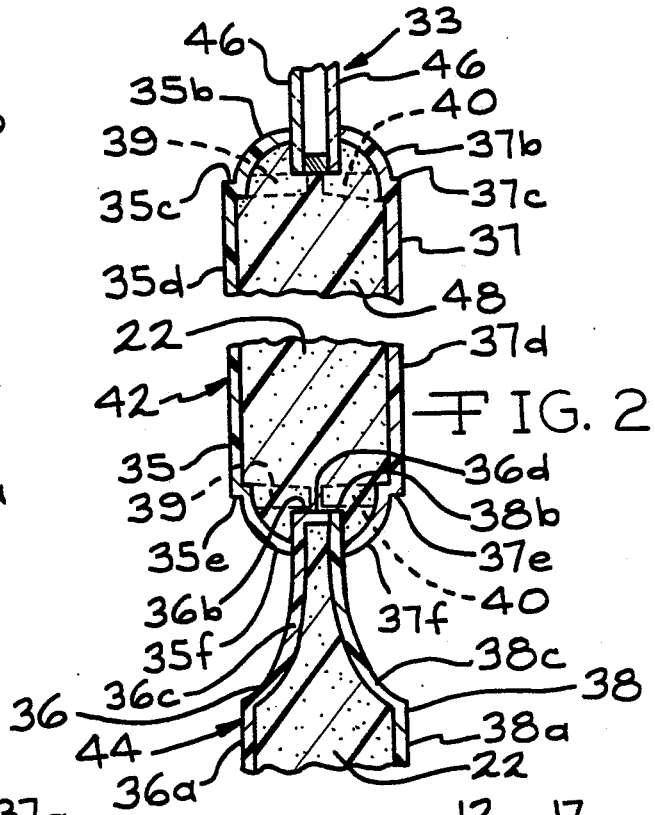
FIG. 2 is a partial sectional view taken through line 2—2 of FIG. 1.

Referring now to FIGS. 1 and 2, the first inner skin 35 extends vertically from an upper arcuate segment 35*b* to an upper step 35*c* to a flat planar segment 35*d* to a lower step 35*e* and terminates at a lower arcuate segment 35*f*. Similarly, the first outer skin 37 extends vertically from an arcuate segment 37*b* to an upper step 37*c* to a flat planar segment 37*d* to a lower step 37*e* and terminates at a lower arcuate segment 37*f*. The first inner skin 35 has a series of spaced apart abutments 39 extending inwardly toward the opposing first outer skin 37 in the area of the upper and lower steps 35*c* and 35*e*. Similarly, the first outer skin 37 has a series of spaced apart abutments 40 extending inwardly toward the opposing first inner skin 35 in the area of the upper and lower steps 37*c* and 37*e*.

The ends of the opposing arcuate segments 35*b*, 37*b* and 35*f*, 37*f*, are spaced from one another when the first inner skin 35 and first outer skin 37 are joined to the respective frame inner and outer skins 14 and 16 as shown in FIG. 4. As can be seen in FIG. 2, when such skins 35 and 37 are so positioned, the ends of the arcuate segments 35*b* and 37*b* engage the lower edge of the window panel 33 and the window panel 33 is supported on the upper set of abutments 39 and 40.

Figure 5:
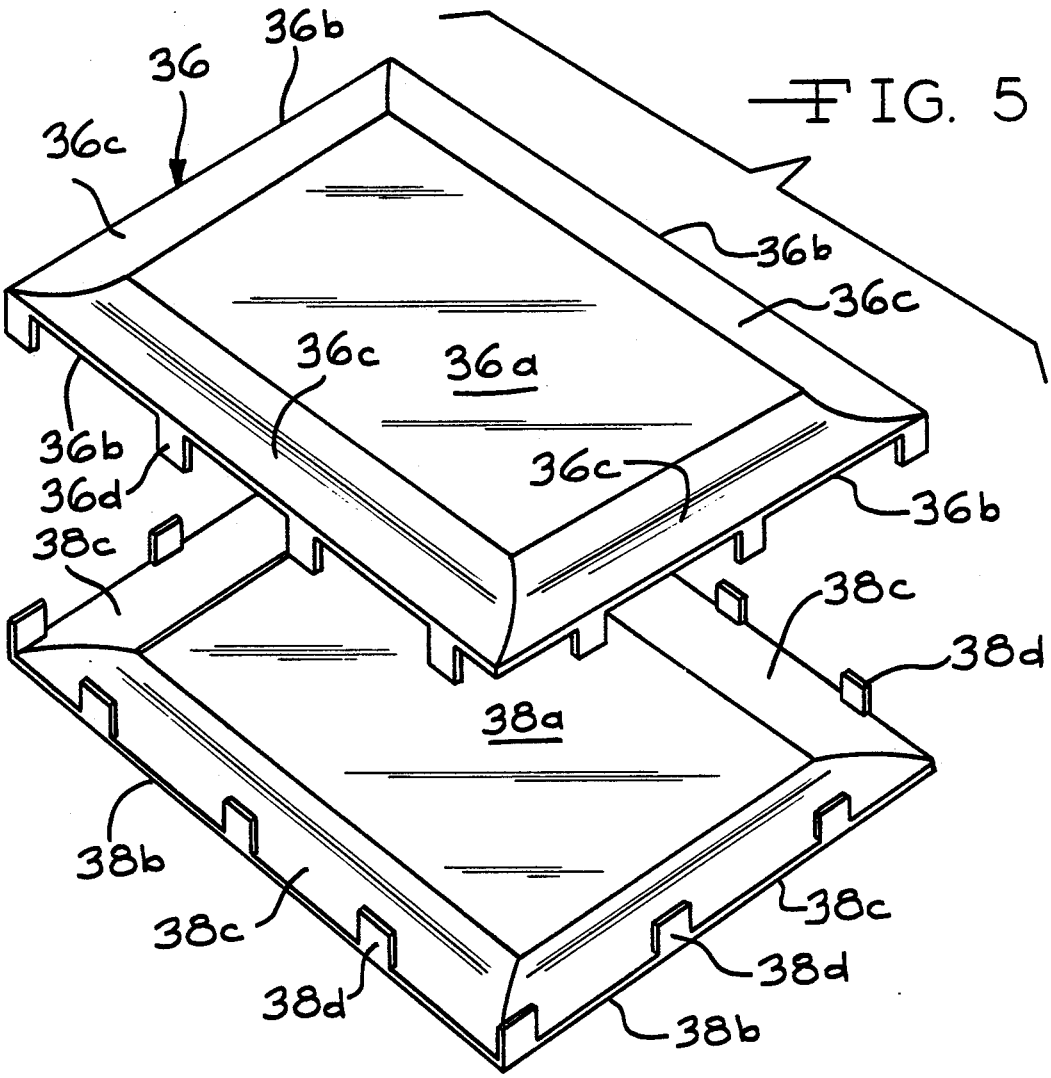
FIGS. 5 and 6 are perspective views of the recessed panel portion of the central panel with FIG. 5 showing the skin members forming such recessed panel separated before assembly and FIG. 6 showing them joined so as to provide passages for the introduction of foam from the frame.
Figure 6:
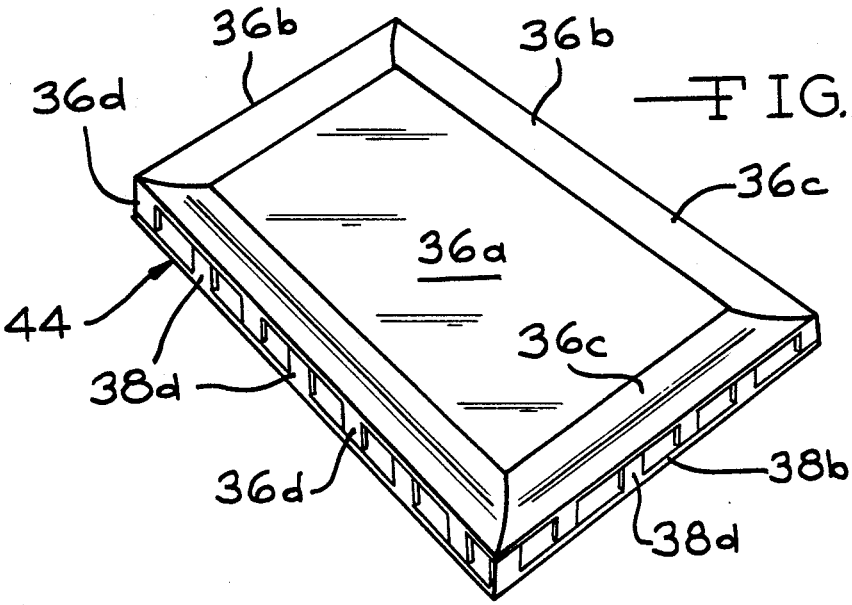

As can be seen in FIGS. 2, 5 and 6, the second inner skin 36 has a generally planar section 36*a*, peripheral edges 36*b* and curved segments 36*c* sloping toward the opposing second outer skin 38 between the planar section 36*a* and peripheral edges 36*b*. Depending from the peripheral edges 36*b* are a series of spaced apart tabs 36*d* which extend inwardly toward the opposing second outer skin 38. Similarly, the second outer skin 38 has a generally planar section 38*a*, peripheral edges 38*b* and curved segments 36*c* sloping toward the opposing second inner skin 36 between the planar section 38*a* and peripheral edges 38*b*. Depending from the peripheral edges 38*b* are a series of spaced apart tabs 38*b* which extend inwardly toward the second inner skin 36. As can be seen in FIGS. 2 and 6, each of the tabs 36*d* engages the opposing second outer skin 38 and each of the tabs 38*d* engages the opposing second inner skin 36 to maintain such skins in the proper spaced apart position for introducing foam in the spaces between the alternate spaced apart tabs 36*d* and 38*d*.

As shown in FIG. 2, the upper peripheral edges 36*b* and 38*b* of the joined second inner skin 36 and second outer skin 38 are positioned in the gap between the lower arcuate segments 35*f* and 37*f* of the first inner and outer skins 35 and 37. The abutments 39 and 40 serve to position the upper peripheral edges **36*b* and 38*b* so that the rail 42 is properly aligned relative to the recessed panel 44**.

That portion of the panel skins 14 and 16 forming the lower horizontal rail 24 has a cross sectional configuration similar to that shown for the vertical stiles 23 in FIG. 3 including the abutments 31 and 32. Such abutments 31 and 32 for the lower horizontal rail are engaged by and support the lower edges **36*b* and 38*b* of the second inner skin 36 and second outer skin 38 which extend into the gap between the interior edges 25 and 26. The abutments 31 and 32 along the portion of the panel skins 14 and 16 forming the vertical stiles 23 serve to position the peripheral edges 36*b* and 38*b* which extend into the gap between the interior edges 25 and 26 of such portion of panel skins 14 and 16**.

As will be appreciated, the spaces between the respective tabs **36*d* and 38*d* provide passages for the foam to flow into the cavity defined between the opposing second inner skin 36 and second outer skin 38. Such foam can enter the cavity between the second inner skin 36 and second outer skin 38 through either of the vertical stiles 23, the lower of the frame horizontal rails 24, and the horizontal rail 42** of the central panel.

Referring to FIG. 1, the foam insulating material may be introduced in flowable foamable form through a nozzle N inserted in an opening in the upper edge of the assembled skins 14 and 16 forming the frame and having the window panel and the members forming the central panel assembled therewith. The flowable foam insulating material will flow through the cavity 20 formed by the skins 14 and 16 and from the cavity 20, (1) through the gap formed by the ends 25 and 26 and into the cavity 48 formed by the first inner and outer skins 35 and 37, (2) through the spaces between the tabs **36*d* and 38*d* and into the cavity defined between the second inner and outer skins 36 and 38 and (3) with foam from cavity 48 into sealing engagement with the peripheral edge of the window panel 33**. Following introduction of the foam, the nozzle N will be removed and the opening in the edge sealed.

The foam insulating material can be rigid polyurethane foam or any reactive two component polymer or adhesively bonded polystyrene. Preferrably, the insulating material will be foamed in situ after introduction of foamable material into the cavity. Once the foam insulating material has cured, the components of the assembly are held together by the adhesion of the foam to the interior surfaces of the skins 14, 16, 35, 36, 37 and 38 and other components including the window panel 33.

Referring now to FIGS. 7–11, there is shown a modified embodiment of my new door assembly. In this embodiment there is provided a frame 12' having an inner skin 14' and an outer skin 16' which are joined together at their exterior edges by means of wooden stiles 18'. The frame 12' defines an opening in which a central panel 50 is affixed. In this embodiment, the entire central panel 50 is produced using a single inner skin 51 and single outer skin 52. With one significant exception, namely interruptions 49 in the arcuate segment 29' along each of the interior edges, the inner frame skin 14' is similar in construction and configuration to the inner frame skin 14 of the embodiments of FIGS. 1–6. Thus, the inner skin 14' extends from an exterior edge 15' toward an interior edge 25' following a generally planar path to a step 27' with an arcuate segment 29' joining the step 27' with the interior edge 25'. Similarly, the opposing skin 16' extends from an exterior edge 17' toward an interior edge 26' following a generally planar path to a step 28' with an arcuate segment 30' joining the step 28' with the interior edge 26'.

As can be seen from FIG. 10, the inner skin 14' has an interruption 49 in its arcuate segments 29' along each of the four interior edges. The number and location of interruptions 49 will be governed by the design of the inner skin 51.

The inner skin 51 is formed as a single unitary piece. As shown it is provided with four rectangular recessed panels 54, a horizontal rail 56 and a vertical rail 58. As will be appreciated, there may be a greater or lesser number of recessed panels 54 and rails 56, 58, depending on the design desired for the central panel.

A plurality of tabs 60 extend inwardly from the edge of the inner skin 51 toward the opposing skin. The opposing skin 52 may have a similar configuration, including tabs, and is, therefore, not shown in overall perspective in the drawings. The tabs serve to maintain the proper spacing between the inner and outer skins 51 and 52 with the spaces between the tabs 60 providing passageways from the cavity formed by the first and second skins 14' and 16' to the cavity between the assembled inner and outer skins 51 and 52.

The portions of the skins forming the rails 56 and 58 extend exteriorly beyond the plane formed by the tabs 60 on the respective edges. The ends of the rails 56 and 58 fit into the gaps formed by the interruptions 49 with one end occupying the space formed by each such interruption 49. Thus, the number and location of each of the interruptions 49 should be the same as the number and location of the ends of the respective rails 56 and 58. In other words, there are two interruptions for each rail. The exterior ends of the rails 56 and 58 abut the steps 27' of skin 14'. Each of such ends has depending therefrom a hook 62 which engages an inwardly facing flange formed by the step 27' of the inner skin 14'.

Similarly, the skin 52 has a hook 63 depending from the exterior ends of those portions forming rails 56 and 58. Each of the hooks 63 engages an inwardly facing flange formed by each of the step 28' of outer skin 16' in the area of the interruptions 49.

As can be seen from FIG. 9, that portion of the inner skin 51 and outer skin 52 forming the exterior edges of the recessed panels 54 extend within the gap defined by the ends 25', 26' of the respective arcuate segments 29', 30' of the respective frame inner and outer skins 14' and 16'. As will be appreciated, the section line for FIG. 9 is located between the tabs 60 and, therefore, no tabs are shown in FIG. 9. There is thus provided passageways through which foam material may flow from the cavity defined by the frame skins 14' and 16' to the cavity defined by the central panel skins 51 and 52 to form a unitary foam core 64.

In order to assemble the door assembly of the embodiment of FIGS. 7–11, the inner and outer skins 51 and 52 forming the central panel are positioned between the inner and outer skins 14' and 16' forming the frame and are moved into engagement such that the skins 14' and 16' of the frame assembly engage the wooden stiles 18' forming the edges. When so positioned the hooks 62 and 63 of the inner and outer skins 51 and 52 will be engaged with the flanges formed by the steps 27' and 28' respectively, of the frame skins 14' and 16'. The tabs 60 will abut against the edge of the opposing central panel outer skin 52 and the peripheral edges of the skins 51 and 52 will be positioned between the spaced apart interior edges 25' and 26' of the inner and outer frame skins 14' and 16'. Foamable polyurethane may then be introduced into the cavities to form the core.

Referring now to FIGS. 12–17, there is shown yet another embodiment in which the entire central panel is produced using a single inner skin 70 and a single outer skin 80, each of which is formed as a single unitary piece as in the embodiment of FIGS. 7–11. In this embodiment, the central panel occupies only the lower portion of the opening defined by frame, with the upper portion of such opening having a window or, if desired, a separate panel.

The frame 12" includes an inner skin 14" and an outer skin (not shown). As in the previous embodiments, the inner frame skin 14" defines a pair of vertical stiles 23" and upper and lower horizontal rails 24". The frame skin 14" extends from an exterior edge 15" adjacent a wooden stile (not shown) to an interior edge 25" following a generally planar path to a step 27". Arcuate segment 29" joins the step 27" to the interior edge 25". In contrast to the embodiment of FIGS. 7–11, the arcuate segment 29" extends completely around the interior periphery of the skin 14" and there are no gaps or interruptions similar to the interruptions 49 in the embodiment of FIGS. 7–11.

The central panel in this embodiment includes an inner skin 70 and an opposing outer skin 80. The inner skin 70 includes a horizontal rail portion 71 and a recessed panel portion 72. The recessed panel portion 72 has a generally planar section **72*a*, peripheral edges 72*b* and curved segments 72*c* sloping toward the opposing outer skin 80 between the planar section 72*a* and peripheral edges 72*b*. A series of spaced apart tabs 72*d* extend from the edges 72*b* toward the opposing outer skin 80 which is similar to the skin 70 including having tabs 80*d* extending inwardly from the edges 80*b***.

Joined to the upper one of the peripheral edges **72*b* is the horizontal rail portion 71. Such rail portion 71 includes a lower arcuate segment 71*a* integral with and extending from the upper of the peripheral edges 72*b*, a lower step 71*b*, a planar portion 71*c*, an upper step 71*d* and an upper arcuate segment 71*e* which terminates at an upper free edge 71*f***.

As can be seen from FIG. 17, there is also included a series of abutments **71*g* extending inwardly from the upper step 71*d***. The abutments provide support means for a window (not shown) which may be positioned in the upper part of the opening.

As can be seen in FIGS. 12, 13 and 14, the planar portion **71*c* of the rail portion 71 extends the full distance from the step 27" of one of the vertical stiles 23" to join with the step 27" of the opposite vertical stile 23" of the frame inner skin 14". This is a greater distance than the distance required to be spanned by the recessed panel portion 72 which must extend only slightly more than the distance between the interior edges 25" of the vertical stiles 23". Thus, the rail portion 71 projects exteriorly beyond the recessed panel portion 72**.

As can be seen from FIGS. 12, 14 and 15, the portion of the inner skin 70 forming the ends of the rail 71 are on the outside surface of the arcuate segments 29" and thus, when assembled, cover those portions of such arcuate segments. In contrast, those portions of the curved segments **72*c* adjacent the side and bottom peripheral edges 72*b* are under the arcuate segments 29" as they extend into the gap formed by the interior edge 25" of frame inner skin 14"** and the interior edge of the opposing frame outer skin (not shown).

In view of the fact that the horizontal rail sections 71 of the central panel inner skin 70 skin extend beyond the periphery of the opening defined by the inner edge 25" of the frame inner skin 14", it will be necessary to twist such central panel inner skin 70 as shown schematically in FIG. 13 in order to position it in the opening of the frame inner skin 14". Since the distance between the ends of the rail portion 71 and the distance between the peripheral edges **72*b* along the sides of the recessed panel portion 72 are both greater than the distance between the interior edges 25" of the vertical stiles 23" and yet, as assembled, the ends of the rail portion 71 are on the outside surface of the arcuate segments 29" while the peripheral edges 72*b* of the recessed panel portion 72 are on the opposite side, it will be appreciated that a notched or recessed area 71*d* must be provided in the lower arcuate segment 71*a* of the rail portion 71. The distance between the notched area 71*d* at one end of the arcuate segment 71*a* and a similar notched area at the other end of arcuate segment 71*a* must be no greater than the distance between the interior edges 25" of the vertical stiles 23"**.

The skins forming the outer surfaces of the respective frame and central panel will have a similar construction to the inner skins 14" and 70 respectively. As will be readily appreciated, the design is such as to permit communication between the cavity formed by the assembled frame inner skin 14" and outer skin (not shown) and the cavity formed by the assembled central panel inner skin 70 and outer skin 80. As a result, the foamable core material may be readily introduced throughout both cavities to form a unitary foam core.

With the construction shown in the various embodiments, there is provided the door assembly in which the central panel members may be readily formed in any one of a variety of standard designs and assembled to members forming a frame with a foam core introduced throughout the frame and panel sections jointly. The foam utilized may be formed of polyurethane which has adhesive characteristics to join the compression molded skins together.

Having thus described the invention in detail, it should be understood that various modifications and changes may be made in the invention without departing from the scope and spirit of the claims.

I claim:

1. A door assembly comprising:

(a) a frame having first and second compression molded skins each having an exterior edge and an interior edge, said first and second skins, when joined together, defining a cavity for receiving a foam core, said interior edges cooperating to define a central opening;

(b) a central panel within said central opening, said central panel including inner and outer compression molded skins, said inner and outer skins cooperating to define a cavity for receiving a foam core and having exterior edges engaged to the interior edges of the first and second skins;

(c) means for positioning said central panel in the central opening of said frame;

(d) means in said frame and said central panel providing communication between the cavities of the frame and the central panel; and, (e) a foam core extending throughout said frame and central panel cavities.

2. A door assembly according to claim 1, wherein the means for positioning the central panel in the frame includes stops extending from the surface of at least one of the first and second frame skins inwardly toward the opposing skin, said stops being spaced from said interior edge, said central panel having exterior edges abutting said stops.

3. A door assembly according to claims 1 or 2, wherein at least one of said central panel skins has a plurality of spaced apart tabs extending inwardly toward and engaged to the opposing central panel skin to maintain the exterior edges of said central panel skins in spaced relationship to each other, said means for communication between the cavities including the spaces between said tabs.

4. A door assembly according to claim 1, wherein for each of the first and second frame skins, the respective sets of interior edges defining said central opening include spaced apart horizontal edges defining the upper and lower extent of said central opening and spaced apart vertical edges defining the side to side extent of said central opening and wherein said central panel includes a rail portion and a recessed panel portion;

(a) said rail portion having inner and outer skins extending horizontally across said central opening, each of said rail skins having spaced apart ends engaged to opposed vertical interior edges of said first and second frame skins, respectively, said inner and outer rail skins having a horizontally extending lower edge, said rail skins defining a cavity, (b) said recessed panel portion having inner and outer skins having upper and lower horizontal exterior edges, right and left vertical exterior edges and a plurality of spaced apart tabs adjacent each of said edges extending inwardly toward and engaged to the opposing recessed panel skin, said recessed panel skins defining a cavity, the opposing upper horizontal exterior edges positioned between and engaged to the lower edges of said inner and outer rail skins, the opposing lower exterior edges positioned between and engaged to lower interior horizontal edges of said first and second frame skins and the right and left vertical exterior edges positioned between and engaged to right and left interior edges, respectively, of said first and second frame skins.

5. A door assembly according to claim 4, wherein said inner and outer rail skins have abutments extending inwardly toward the opposing rail skin adjacent the lower edge, said abutments engaged to the upper edges of the respective recessed panel skins and being spaced apart to provide communication between the cavity of said rail portion and the cavity of said recessed panel portion.

6. A door assembly according to claim 5, wherein said inner and outer rail skins have abutments extending inwardly toward the opposing skin adjacent the upper edge and wherein a window panel is positioned in the portion of said central opening above the rail skins, the lower edge of window panel positioned between the opposing upper edges of the inner and outer rail skins and engaged to said abutments.

7. A door assembly according to claim 1, wherein said central panel occupies the entire central opening and wherein said inner and outer central panel skins are each one-piece and each has at least one horizontal rail portion and have recessed panel portions on opposite sides of said rail portion and hook means at each end of said horizontal rail portions engageable with the opposed portions of the respective first and second frame skin interior edges.

8. A door assembly according to claim 7, wherein the interior edge of said first and second frame skins defining said central opening are recessed at the locations of engagement by said hook means.

9. A door assembly according to claim 1, wherein said central panel occupies only a portion of said central opening and wherein said inner and outer central panel skins are two-piece and include first and second inner skins and first and second outer skins, said first inner and first outer skin cooperating to define a horizontal rail portion and said second inner and second outer skin cooperating to define a recessed panel portion, the exterior edges of the second inner and second outer panel skins being positioned between said first and second frame skin interior edges and the first inner and first outer skins having the interior edges of said frame skins positioned therebetween.

10. A door assembly according to claim 9 wherein the second inner and second outer skins have, at their exterior edges, a plurality of spaced apart tabs extending inwardly toward and engaged to the opposing panel skin.

11. A door assembly according to claim 1, wherein said central panel occupies only a portion of said central opening and wherein said inner and outer panel skins are each one-piece and each have a horizontal rail portion and a recessed panel portion depending from said horizontal rail portion, the portions of said inner and outer panel skins defining the ends of said horizontal rail portion engaging therebetween interior edges of the first and second frame skins and the portions of said inner and outer panel skins defining exterior edges of said recessed panel portion being positioned between the interior edges of said first and second frame skins.

12. A door assembly comprising in combination a rectangular frame defining an opening and a central panel in said opening (a) said frame including first and second compression molded skins, said skins having interior peripheral edges defining said opening and exterior peripheral edges, means for joining said exterior peripheral edges while leaving a gap between said interior peripheral edges, said skins with said joined exterior peripheral edges cooperating to define a cavity;

(b) said central panel including inner and outer compression molded skins having peripheral edges joined to the interior peripheral edges of the respective first and second skins, at least a portion of each of said inner and outer panel skins peripheral edges positioned within said gap and having means for maintaining them in spaced relationship to each other, said panel inner and outer compression molded skins cooperating to define a panel cavity communicating with the cavity defined by said frame skins, and (c) a foam core extending throughout both the frame cavity and panel cavity and bonded to said frame skins and said panel skins.

13. A door assembly according to claim 12 wherein foamable material for said foam core is flowed through the frame cavity and from the frame cavity into the panel cavity.

14. A door assembly according to claim 12, wherein the means for maintaining the peripheral edges of said inner and outer panel skins in spaced relationship includes a plurality of spaced apart tabs depending from said panel skins peripheral edges and extending inwardly toward and engaging the opposing panel skin.

15. A door assembly according to claim 12 wherein the portion of said first and second frame skins adjacent the interior peripheral edges has a lip directed inwardly toward the opposing skin, the ends of the respective lips defining said gap.

16. A door assembly according to claim 15, wherein said lips along each of said frame skins interior peripheral edges has an interruption and wherein each of said central panel inner and outer skins each have at least one rail portion integrally formed with a recessed panel portion, each of the ends of said rail portion being aligned with and positioned in one of said interruptions, hook means at each of said ends, each of said hook means engageable with the aligned portion of one of said frame skins.

17. A door assembly according to claim 15, wherein said lip along each of said frame skins interior peripheral edges is continuous and each of said central panel inner and outer panel skins has integral rail and recessed panel portions, said rail portions extending horizontally to opposed ends, each of said ends engaging the outer surface of one of said lips, each of said recessed panel portions having a first peripheral edge joined to the rail portion of its respective skin and second, third and fourth peripheral edges extending into said gap.

18. A door assembly according to claim 12, wherein said central panel has first and second inner skins and first and second outer skins;

said first inner skin and first outer skin extending horizontally across said frame opening and each engaging opposite interior peripheral edge of one of said frame skins and cooperating to define a rail portion having a cavity communicating with the frame cavity, said second inner skin and said second outer skin cooperating to define a recessed panel portion and a cavity, said recessed panel portion having a rectangular configuration and having peripheral edges along three sides extending within said gap and the peripheral edges along the fourth side extending between said first inner skin and said first outer skin, the cavity of said recessed panel portion communicating with both the frame cavity and the rail portion cavity.

19. A door assembly according to claim 18, wherein at least one of said frame skins has stops extending inwardly toward the opposing frame skin and spaced from said interior peripheral edges, the peripheral edges along three sides of said second inner skin and said second outer skin abutting said stops.

20. A door assembly according to claims 18 or 19, wherein at least one of said first inner skin and first outer skin has stops extending inwardly toward the other, said stops abutting the peripheral edges along the fourth side of at least one of the second inner skin and second outer skin.

21. For use with a frame having first and second compression molded skins, each having a generally rectangular exterior edge and a generally rectangular interior edge, said first and second skins, when joined together, defining a cavity for receiving a foam core, a central panel comprising inner and outer compression molded skins having exterior edges, said inner and outer skins cooperating when joined together to define a cavity for receiving a foam core; a plurality of spaced apart tabs extending from the exterior edges of at least one of said panel skins in a direction toward the opposing panel skin (a) to maintain the exterior edges of said panel skins in spaced relationship to each other when said panel skins are joined together and, (b) when assembled with said first and second compression molded skins, providing means for communication between the cavity of said frame and the cavity of the panel.

22. A central panel according to claim 21 further including inner and outer rail skins, each of said inner and outer rail skins having spaced apart ends engageable with opposed interior edges of said first and second skins, respectively, and a lower longitudinal edge engageable with an exterior edge of one of said panel skins and cooperating when so engaged to define a cavity communicating with at least one of said panel cavity or said frame cavity.

23. A central panel according to claim 22, wherein at least one of said rail skins has one or more abutments extending from its inner surface toward the opposing rail skin, said abutments adapted to engage an exterior edge of said central panel.

24. A central panel according to claim 21, wherein said inner and outer panel skins have (a) at least one integral horizontal rail portion, (b) recessed panel portions on opposite sides of said rail portion and (c) hook means at each end of said horizontal rail portions, said hook means adapted to engage opposed portions of the interior edges of the respective first and second frame skins.

25. A central panel according to claim 21, wherein said inner and outer central panel skins each has a rail portion and recessed panel portion integral therewith, the ends of said rail portions adaptable to clamp therebetween opposing portions of the interior edges of said frame skins and the free peripheral edges of said panel portions adaptable to be clamped between opposing portions of the interior edges of said frame skins when the frame skins and central panel skins are joined together.

26. A central panel according to claim 25, wherein the transition area between the rail portion and the recessed panel portion for each skin extends generally parallel to said rail portion and the distance between the opposite ends of said transition area is less than the distance between the opposite ends of said rail portion.

* * * * *